US005296781A

United States Patent [19]

Lee

[11] Patent Number: 5,296,781

[45] Date of Patent: Mar. 22, 1994

[54] IMPREGNATED CATHODE

[75] Inventor: Kyung Sang Lee, Kumi, Rep. of Korea

[73] Assignee: Goldstar Co. Ltd., Seoul, Rep. of Korea

[21] Appl. No.: 813,648

[22] Filed: Dec. 27, 1991

[30] Foreign Application Priority Data

Dec. 29, 1990 [KR] Rep. of Korea ..... 21698

[51] Int. Cl.[5] ..... H01J 29/04

[52] U.S. Cl. ..... 313/446; 313/337

[58] Field of Search ..... 313/446, 337

[56] References Cited

U.S. PATENT DOCUMENTS 3,823,453 7/1974 van Stratum et al. ..... 313/337

4,403,169 9/1983 Blanken ..... 313/446

*Primary Examiner*—Sandra L. O'Shea

*Attorney, Agent, or Firm*—Leonard Bloom

[57] ABSTRACT

An impregnated pallet including a porous metal body to which an electron radiating material is impregnated, a cathode ring having an upper portion in which the impregnated pallet is fitted, and a cathode sleeve containing a heater therein and having a closed upper end mounted to the lower end of the cathode ring such that the closed upper end surface thereof is in close contact with the lower surface of the impregnated pallet, so as to transmit directly the heat from the heater accumulated in the cathode sleeve to the impregnated pallet. A plurality of uniformly spaced metal ribbons are formed integrally with the lower end of the cathode ring. Each metal ribbon has an end fixed to the closed upper end surface of a cathode holder. In accordance with the present invention, the impregnated cathode has an improved construction capable of shortening the video producing time and simplifying the manufacturing process, thereby improving the workability and the productivity.

2 Claims, 2 Drawing Sheets

IMPREGNATED CATHODE

BACKGROUND OF THE INVENTION

1. Field of the Invention

The present invention relates to an impregnated cathode, and more particularly to an impregnated cathode with a construction comprising a cathode ring having an upper end to which an impregnated pallet is fitted and a lower end to which a cathode sleeve is fitted and a plurality of metal ribbons formed integrally with the cathode ring, each metal ribbon having an end fixed to a cathode holder, thereby capable of simplifying the manufacturing process and shortening the video producing time.

2. Description of the Prior Art

Impregnated cathodes have been mainly used in oscilloscopes which require high cathode current. Recently, they have been also applied to electron tubes which are used in televisions, since the electron tubes require high cathode current, according to the tendency of high resolution and large screen in televisions.

Referring to FIGS. 1A and 1B, there is shown an example of conventional impregnated cathode constructions. As shown in the drawings, the cathode comprises a cylindrical cathode cup 12 made of a heat-resistant metal and closed at its lower end, an impregnated pallet 11 fitted in the cathode cup 12 and having a porous heat-resistant sintered body to which an electron radiating material is impregnated, and a cylindrical cathode metal sleeve 13 having a closed upper end and mounted to the cathode cup 12 such that the closed upper end surface is in close contact with the lower end surface of the cathode cup 12. The cathode also comprises a cylindrical cathode holder 14 surrounding the cathode sleeve 13, a plurality of metal ribbons 15 adapted to fixedly maintain the cathode sleeve 13 and the cathode holder 14 and having one end fixed to the upper end surface of the cathode sleeve 13 and the other end fixed to the outer surface of the upper end of cathode holder, and a coil type heater 18 adapted to heat the interior of cathode and received in the cathode holder 14 to extend into the interior of cathode sleeve 13 such that the outer surface thereof is uniformly spaced from the inner surface of the cathode sleeve 13, the heater having an upper end being in contact with the inner surface of the upper end of cathode sleeve 13.

In the drawings, the reference numerals 16 and 17 designate fixing areas where the metal ribbons are fixed to the cathode sleeve 13 and the cathode holder 14.

Now, the operation of the conventional cathode with the above-mentioned construction will be described.

As a drive power is supplied to the heater 18 disposed in the cathode which has been assembled in an electron tube, the heater 18 emits heat, thereby causing the cathode to be heated. At this time, the heat emitted from the heater 18 is transmitted to the cathode cup 12, via the upper end surface of the cathode sleeve 13. The transmitted heat to the cathode cup 12 is then transmitted to the impregnated pallet 11, so that the impregnated pallet 11 radiates electrons, by virtue of the transmitted heat.

In the case of the above-mentioned construction, however, there is a disadvantage of increasing the video producing time, in that the heat generated from the heater 18 is transmitted to the impregnated pallet 11, via the closed surface of the cathode sleeve 13 and the closed surface of the cathode cup 12. Herein, the video producing time means the period of from the turning-on time point of the heater 18 to the time point that a video appears on an electron tube screen, as an electron is radiated from the impregnated pallet 11. In making the conventional cathode with the above-mentioned construction, the cathode cup 12 and the cathode sleeve 13 should be also accord with each other, so as to improve the heat transmission efficiency. Furthermore, the metal ribbons 15 should be fixed to the upper end surface of the cathode sleeve 13 at fixing areas 16 which has been accurately predetermined on the upper end surface. However, these works are very troublesome.

SUMMARY OF THE INVENTION

Therefore, an object of the invention is to provide an impregnated cathode with an improved construction capable of shortening the video producing time and simplifying the manufacturing process by eliminating a troublesome centering work which was required in the prior art, for centering the cathode cup and the cathode sleeve.

In accordance with the present invention, this object can be accomplished by providing an impregnated cathode comprising: an impregnated pallet including a porous metal body to which a material radiating electrons upon being subjected to a heat is impregnated; a cathode ring having an upper portion in which the impregnated pallet is fitted; a cathode sleeve containing a heater therein and having a closed upper end mounted to the lower end of the cathode ring such that the closed upper end surface thereof is in close contact with the lower surface of the impregnated pallet, so as to transmit directly the heat from the heater accumulated in the cathode sleeve to the impregnated pallet; a cathode holder surrounding the cathode sleeve and having an upper end surface; and metal ribbons formed integrally with the cathode ring and fixedly mounted to the upper end surface of the cathode holder.

BRIEF DESCRIPTION OF THE DRAWINGS

Other objects and aspects of the invention will become apparent from the following description of embodiments with reference to the accompanying drawings in which.

DESCRIPTION OF THE PREFERRED EMBODIMENT

Figure 1A:
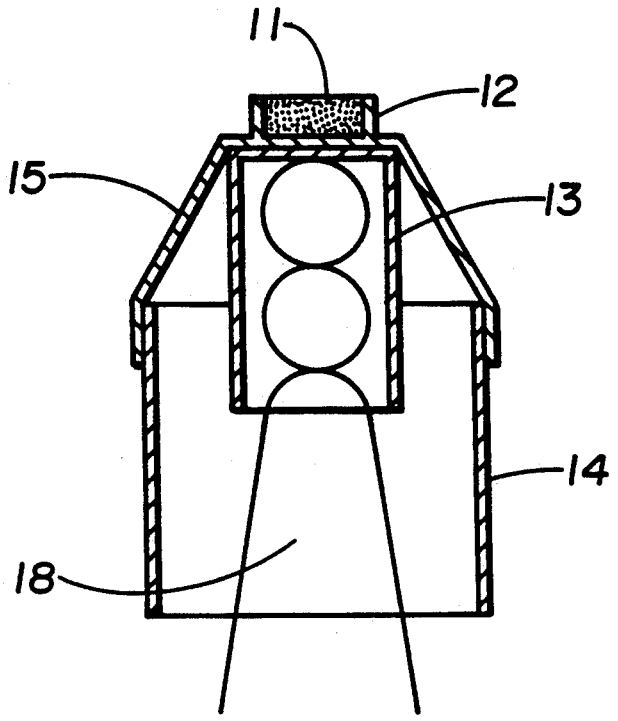
FIG. 1A PRIOR ART
FIG. 1A is a sectional view of the construction of a conventional impregnated cathode.
Figure 1B:
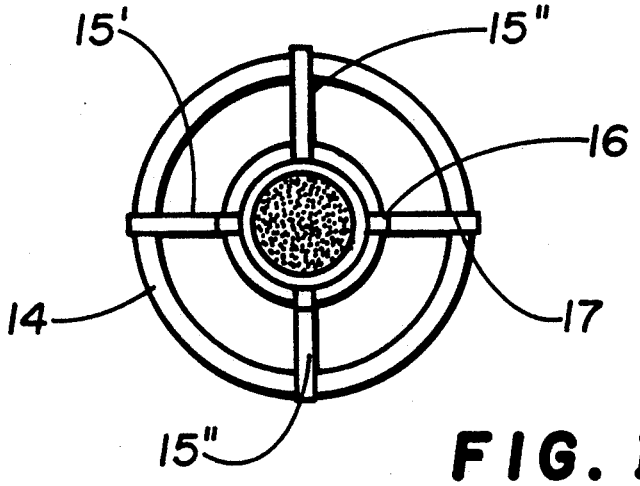
FIG. 1B PRIOR ART
FIG. 1B is a plan view of the conventional cathode construction.
Figure 2A:
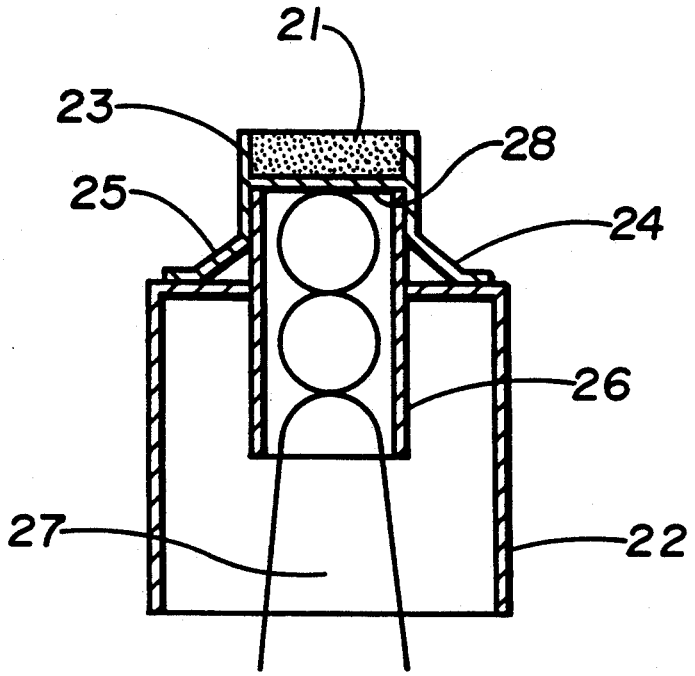
FIG. 2A is a sectional view of a cathode with an improved construction according to the present invention.
Figure 2B:
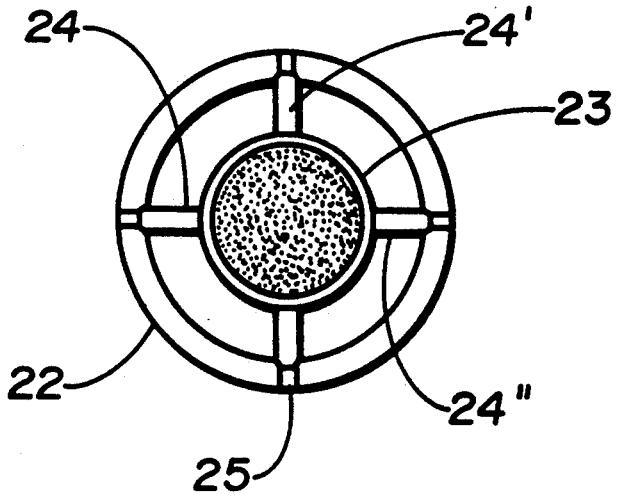
FIG. 2B is a plan view of the cathode construction according to the present invention.

Referring to FIGS. 2A and 2B, there is illustrated an impregnated cathode in accordance with the present invention. As shown in the drawings, an impregnated pallet 21 adapted to radiate electrons including a porous heat-resistant metal body to which an electron radiating material is impregnated, and a cathode ring 23 made of a heat-resistant metal, the impregnated pallet 1 being fixedly fitted in the interior of the upper portion of the cathode ring 2. The cathode also comprises a cylindrical cathode sleeve 26 adapted to transmit the heat accumulated in the interior thereof and having a closed upper end 28 mounted to the lower end of the cathode ring 23 such that the closed upper end surface 28 is in direct contact with the impregnated pallet 21. In the illustrated embodiment, the cathode sleeve 26 is fitted at the upper end thereof in the lower end of the cathode ring 23. The cathode also comprises a cylindrical cathode holder 22 surrounding the lower portion of cathode sleeve 26 such that the inner surface thereof is uniformly spaced from the outer surface of cathode sleeve 26, the cathode holder being adapted to support the construction of cathode, a plurality of metal ribbons 24 formed integrally with the lower end of cathode ring 23 to extend downwardly and outwardly therefrom and fixedly mounted at their lower ends to the upper end surface of cathode holder 22, and a heater 27 disposed in the cathode sleeve 26 and adapted to heat the cathode.

In accordance with the present invention, the cathode holder 22 is provided at the closed surface of the upper end thereof with an opening having an inner surface which is in close contact with the outer surface of the cathode sleeve 26, upon fitting the cathode sleeve 26 in the cathode holder 22 through the opening. As above-mentioned, the ribbons 24 which are uniformly spaced along the periphery of the lower end of cathode ring 23 are fixed on the closed upper end surface of cathode holder 22.

In FIGS. 2A and 2B, the reference numeral "25" designates fixing areas where respective ends of the metal ribbons 24 are fixed to the closed upper end surface of cathode holder 22.

Now, the operation of the cathode with the above-mentioned construction according to the present invention will be described.

As a drive power is supplied to the heater 27, under the condition that the cathode has been assembled in an electron tube, the heater 27 emits heat. The heat generated from the heater 27 is accumulated in the cathode sleeve 26 and then directly transmitted to the impregnated pallet 21, via the closed upper end surface 28 of the cathode sleeve 26. By virtue of the transmitted heat, the impregnated pallet 21 radiates electrons.

Since the radiation of electrons is accomplished by the heat generated from the heater 27 transmitted to the impregnated pallet 21, only via the closed upper end surface 28 of the cathode sleeve 26, the video producing time is considerably shortened, over the prior art wherein the radiation of electrons is accomplished by the heat generated from the heater transmitted to the impregnated pellet, via the closed surface of the cathode sleeve and the closed surface of the cathode cup.

The above-mentioned cathode construction of the present invention also solves the centering problem encountered in the prior art, in that the cathode holder 22 has the opening having an inner surface which is in close contact with outer surface of the cathode sleeve 26 to maintain the cathode sleeve 26 in position, upon fitting the cathode sleeve 26 in the cathode holder 22 through the opening. In accordance with the present invention, the cathode construction also has the ribbons 24 which are formed integrally with the lower end of cathode ring 23 and fixed on the closed upper end surface of cathode holder 22. The opening of cathode holder 22 is formed at the closed upper end surface of cathode holder 22 on which the ribbons 24 are fixed. Accordingly, the fixing areas 25 can be easily predetermined, since the fixing of metal ribbons 24 is carried out under the condition that the cathode sleeve 26 has been fitted in the opening of the cathode holder 22 and maintained in position. As a result, the workability is improved.

As apparent from the above description, the present invention provides an impregnated cathode with an improved construction capable of shortening the video producing time and simplifying the manufacturing process, thereby improving the workability and the productivity.

Although the preferred embodiment of the invention have been disclosed for illustrative purpose, those skilled in the art will appreciate that various modifications, additions and substitutions are possible, without departing from the scope and spirit of the invention as disclosed in the accompanying claims.

What is claimed is:

1. An impregnated cathode comprising:

an impregnated pallet including a porous metal body to which a material radiating electrons upon being subjected to a heat is impregnated;

a cathode ring having an upper portion in which the impregnated pallet is fitted;

a cathode sleeve containing a heater therein and having a closed upper end mounted to the lower end of the cathode ring such that the closed upper end has a surface in direct contact with a lower surface of the impregnated pallet, so as to transmit directly the heat from the heater accumulated in the cathode sleeve to the impregnated pallet;

a cathode holder surrounding the cathode sleeve and having an upper end surface; and means for centering the cathode ring and the cathode holder whereby metal ribbons are formed integrally with the cathode ring and are fixedly mounted to the upper end surface of the cathode holder.

2. An impregnated cathode in accordance with claim 1, wherein the metal ribbons comprises a predetermined number of uniformly spaced metal ribbons formed integrally with the lower end of the cathode ring, each metal ribbon having an end fixed to the closed upper end surface of the cathode holder.

* * * * *